US008062048B2

(12) United States Patent
Ma

(10) Patent No.: US 8,062,048 B2
(45) Date of Patent: Nov. 22, 2011

(54) ELECTRICAL CONNECTOR WITH PIVOTALLY MOVABLE COVER

(75) Inventor: Hao-Yun Ma, Santa Clara, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/607,081

(22) Filed: Oct. 28, 2009

(65) Prior Publication Data

US 2010/0105236 A1 Apr. 29, 2010

(30) Foreign Application Priority Data

Oct. 28, 2008 (TW) ..... 97219172 U

(51) Int. Cl.
*H01R 13/62* (2006.01)

(52) U.S. Cl. ..... 439/331

(58) Field of Classification Search ..... 439/331, 439/330, 73, 630, 326
See application file for complete search history.

(56) References Cited

U.S. PATENT DOCUMENTS

| | | | | |
|---|---|---|---|---|
| 5,813,878 | A * | 9/1998 | Kuwata et al. | 439/326 |
| 6,210,193 | B1 * | 4/2001 | Ito et al. | 439/326 |
| 6,821,146 | B2 * | 11/2004 | Tolmie | 439/577 |
| 6,890,203 | B2 * | 5/2005 | Matsunaga et al. | 439/331 |
| 6,971,919 | B1 * | 12/2005 | Huang | 439/630 |
| 7,063,552 | B2 * | 6/2006 | Matsunaga et al. | 439/326 |
| 7,156,690 | B2 * | 1/2007 | Tolmie | 439/439 |
| 7,160,129 | B2 * | 1/2007 | Yin | 439/331 |
| 7,220,148 | B2 * | 5/2007 | Zhao et al. | 439/630 |
| 7,270,559 | B1 * | 9/2007 | Chen | 439/326 |
| 7,371,095 | B2 * | 5/2008 | Takahashi | 439/261 |
| 7,404,727 | B1 * | 7/2008 | Lee et al. | 439/326 |
| 7,422,462 | B2 * | 9/2008 | Wang | 439/326 |
| 7,435,119 | B2 * | 10/2008 | Chang et al. | 439/188 |
| 7,442,064 | B2 * | 10/2008 | Miwa et al. | 439/326 |
| 7,491,092 | B2 * | 2/2009 | Zhu et al. | 439/633 |
| 2003/0129872 | A1 * | 7/2003 | Tolmie | 439/577 |
| 2004/0067673 | A1 * | 4/2004 | Matsunaga et al. | 439/331 |
| 2006/0057893 | A1 * | 3/2006 | Matsunaga | 439/630 |
| 2008/0038939 | A1 * | 2/2008 | Wu et al. | 439/55 |

FOREIGN PATENT DOCUMENTS

| | | |
|---|---|---|
| CN | 2886854 Y | 4/2007 |
| CN | 200944458 | 9/2007 |

* cited by examiner

*Primary Examiner* — Michael Zarroli
*Assistant Examiner* — Harshad Patel
(74) *Attorney, Agent, or Firm* — Wei Te Chung; Andrew C. Cheng; Ming Chieh Chang

(57) ABSTRACT

An electrical connector (100) for connecting an electronic module (8) with a printed circuit board includes an insulative housing (1) defining a receiving space (12), a number of contacts (2) received in the housing and a cover (3) attached to the housing. The housing forms a base (10) and a pair of lateral walls (11) extending from the base. Each lateral wall has an end portion (112) away from and opposite to the base. The cover is assembled to the end portions of the lateral walls of the housing and is capable of moving from an unlocking position to a locking position. The connector also has a pair of metal ears (5) retained in the housing and can be driven to move into the receiving space and abut against the electronic module when the connector is in the locking position.

20 Claims, 4 Drawing Sheets

ELECTRICAL CONNECTOR WITH PIVOTALLY MOVABLE COVER

BACKGROUND OF THE INVENTION

1. Field of the Invention

The present invention generally relates to an electrical connector which connects an electronic module to a printed circuit board, and more particularly to an electrical connector with a rotateable cover which provides for the locking and unlocking of the electronic module from the connector.

2. Description of Related Art

A conventional electrical connector for interconnecting an electronic module or an IC package or an electronic card with a printed circuit board commonly comprises an insulative base section, a plurality of contacts received in the insulative base section and a cover pivotally attached to the insulative base section. The cover defines a receiving space for receiving the electronic module. When the connector is in an unlocking status, the electronic module is inserted into the receiving space of the cover. When the connector is in the locking position, the cover is rotated and moves towards the insulative base section with the electronic module thereon moving together with the cover and electrically and mechanically connecting the contacts of the connector. However, the cover, which is usually made from a piece of metal sheet, is required to be designed consistently with the shape of the electronic module. When the connector is used to receive a long electronic module, the cover should be opened at a large angle with respect to the base section which will occupy a large space.

Therefore, an improved electrical connector for interconnecting an electronic module with a printed circuit board is required.

BRIEF SUMMARY OF THE INVENTION

An electrical connector in accordance with the present invention is structured for connecting an electronic module with a printed circuit board. The electrical connector comprises an insulative housing defining a receiving space, a plurality of contacts received in the housing and a cover rotatablely attached to the housing. The housing forms a base and a pair of lateral walls extending from the base. Each lateral wall has a distal end portion. The housing defines an opening between the two distal end portions and opposite to the base, from which the electronic module can be inserted into the receiving space. A plurality of contacts are received in the base, each contact comprising a contact portion extending into the receiving space and a tail portion extending opposite to the contact portion for terminating to the printed circuit board. A cover is rotatablely attached to the end portions of the lateral walls of the insulative housing and is pivotally movable from an unlocked position for permitting insertion and removal of the electronic module from the housing to a locked position for the contact portions to electrically connect with the electronic module and for the cover and the housing to sandwich the electronic module therebetween.

DETAILED DESCRIPTION OF THE INVENTION

Figure 1:
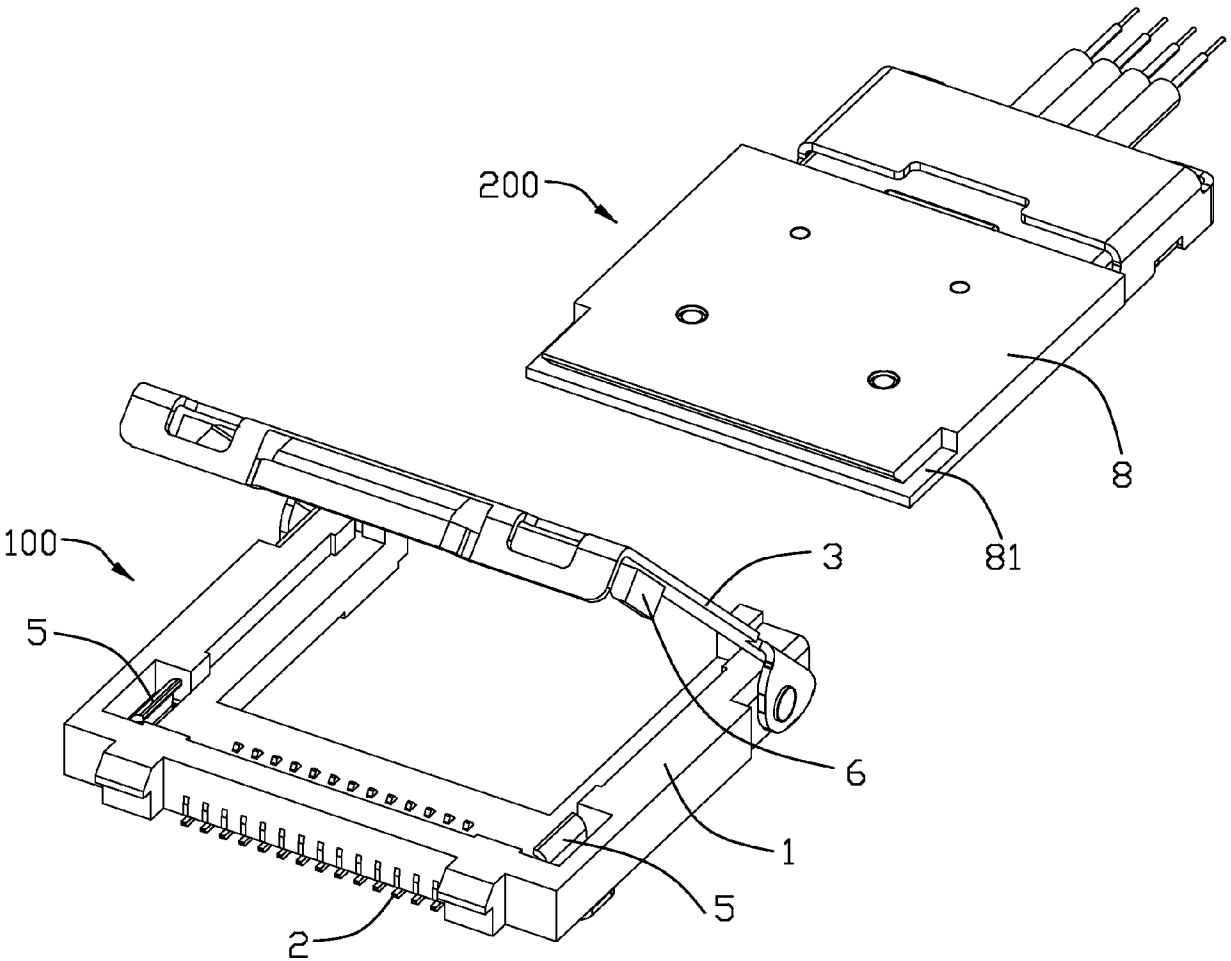
FIG. 1 is a perspective view of an electrical connector in accordance with the present invention and an electronic module assembly.

Reference will now be made to the drawing figures to describe the present invention in detail.

Referring to FIG. 1, an electrical connector 100 in accordance with the present invention is configured for mounting on a printed circuit board (not shown) and electrically connecting the printed circuit board with an electronic module 8. For exemplary, the electronic module 8 shown in this embodiment has a plurality of contact pads (not shown) thereon and is housed in a plug assembly 200.

Figure 2:
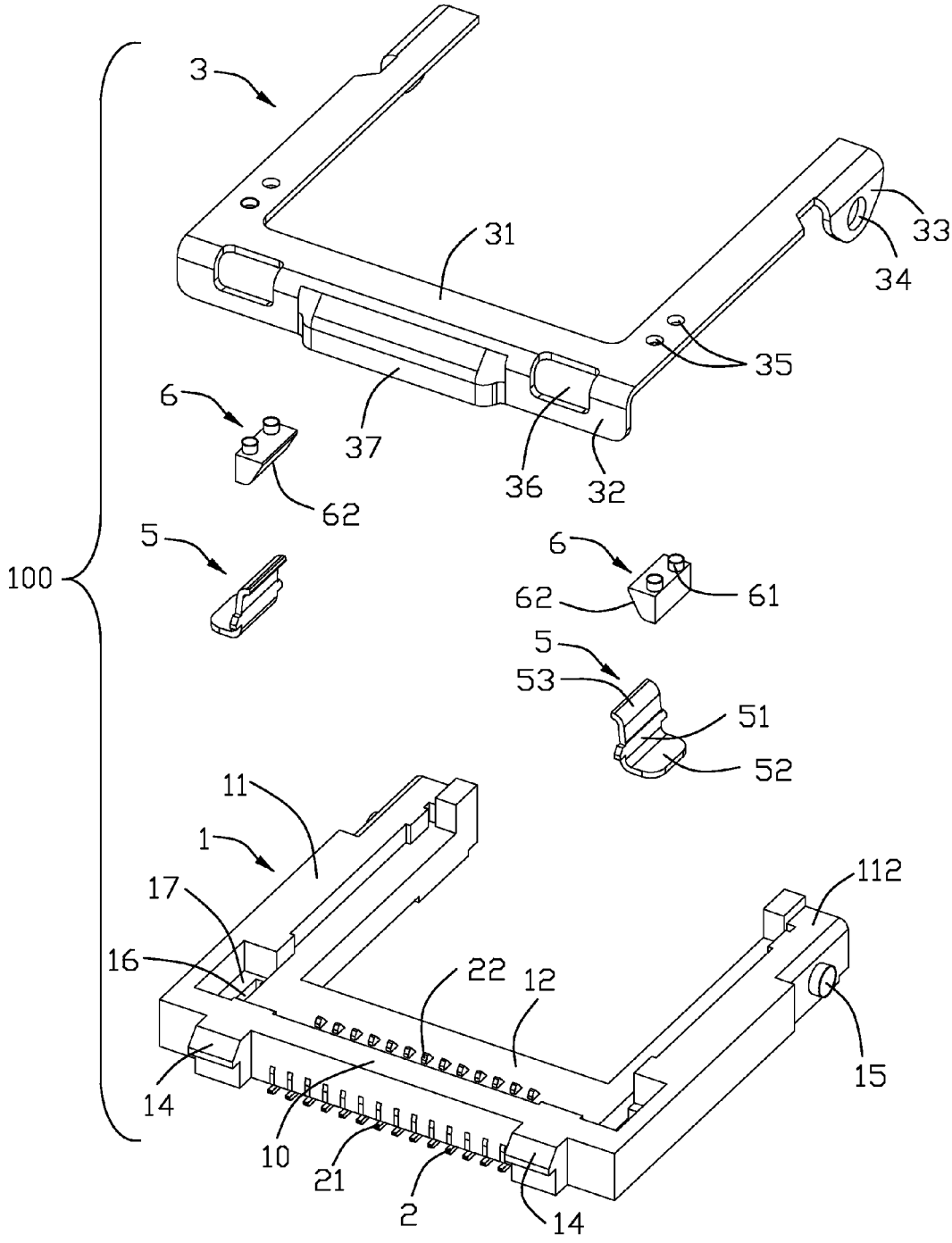
FIG. 2 is an exploded, perspective view of the electrical connector shown in FIG. 1.

Referring to FIG. 2 together with FIG. 1, the electrical connector 100 comprises an insulative housing 1, a plurality of contacts 2 received in the housing 1, a pair of metal/locking ears 5 assembled on the insulative housing 1, and a cover 3 with an actuation wedge or locking head 6 thereon pivotally attached on the insulative housing 1. In this preferred embodiment, both the insulative housing 1 and the cover 3 are configured in U-shape and the cover 3 can be formed from a piece of metal sheet.

The U-shaped, insulative housing 1 comprises an elongated base 10 and a pair of lateral walls 11 extending from opposite ends of the elongated base 10 with a receiving space 12 defined therebetween. The elongated base 10 provides a plurality of contact receiving channels (not labeled) for the contacts 2 extending therethrough, respectively. Each contact 2 has a contact portion 22 exposed to the receiving space for electrically and mechanically connecting with the contact pad of the electronic module 8 of the plug assembly 200 and a solder tail 21 extending out of the insulative housing 1. Each lateral wall 11 defines a slit 16 adjacent to the elongated base 10 for receiving therein the metal ear 5 and a slot 17 above the slit 16, which communicates with the receiving space 12. An end portion 112 is formed at a free end of the lateral wall 11 and extends opposite to the elongated base 10. Each end portion 112 has a hinge formed on an outside face thereof for assembling with the cover 3.

The cover 3 comprises a U-shaped body plate 31 and a front plate 32 extending perpendicularly from a forward edge of the U-shaped body plate 31. The U-shaped body plate 31 provides a pair of pivot portions 33 on two distal free ends thereof Each pivot portion 33 defines therethrough a pivot hole 34 for pivotally receiving the hinge 15 of the end portion 112 of the insulative housing 1. The engagement between the pivot hole 34 and the hinge 15 provides a pivot point, around which the metal cover 3 can rotate from a locked position to an unlocked position or vice verse. A finger access portion 37 is provided on the front plate 32 of the cover for user's manipulation, such as releasing the cover 3 from the locked position to the unlocked position. In the preferred embodiment shown in figures, the front plate 32 defines a pair of cutouts 36 at opposite sides of the finger access portion 37 for engaging with protrusions 14 formed on the elongated base 10 so that securing the cover 3 on the insulative housing 1 when the cover 3 is at the locked position. Understandably, the locking structure on the cover and the housing could be any other types known to the person in the art.

Figure 3:
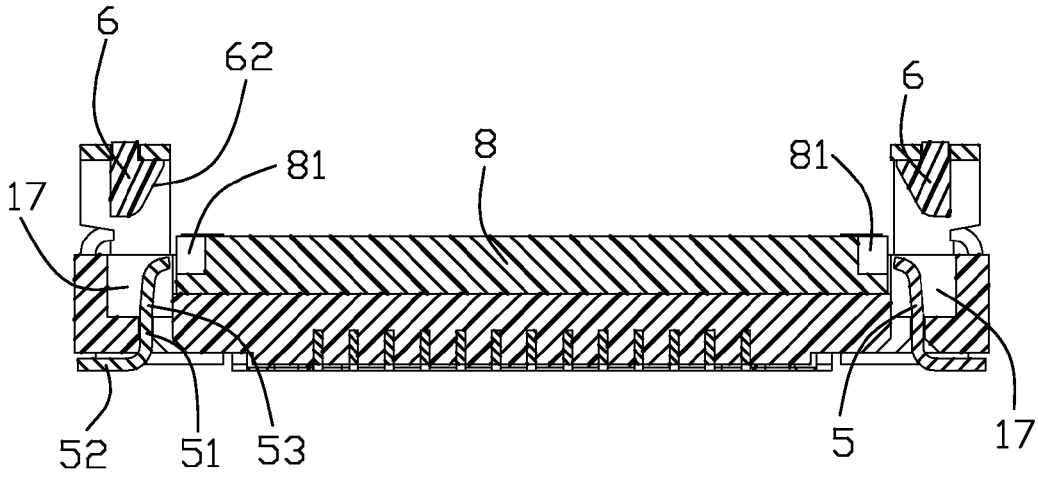
FIG. 3 is a cross-section view of the electrical connector shown in FIG. 1 which is in an unlocking position.
Figure 4:
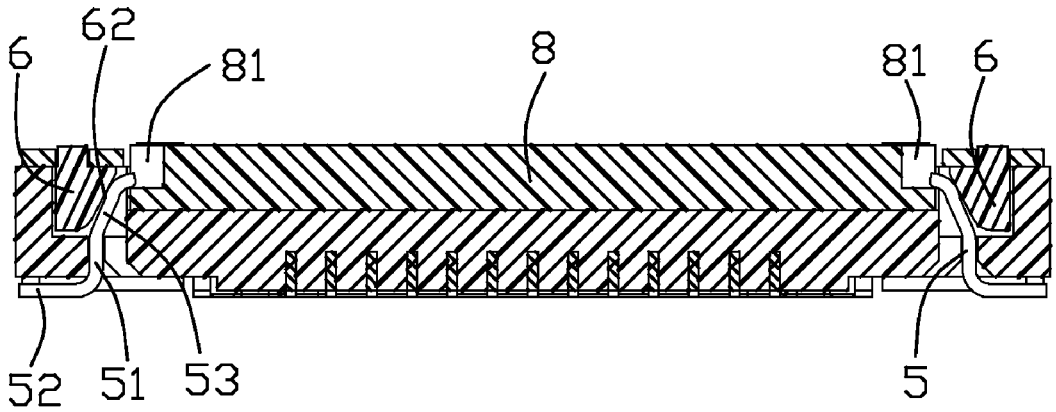
FIG. 4 is a cross-section view of the electrical connector shown in FIG. 1 which is in a locking position.

Referring to FIGS. 3-4 together with FIG. 2, The metal ear 5 employed in the present invention is for either facilitating mounting the connector 100 on the printed circuit board or for locking the electronic module 8 on the connector 100. In this preferred embodiment, the metal ear 5 includes a body portion 51 with barbs formed thereon for fitting in the slit 16, a solder pad 52 extending beyond a bottom of the housing 1 for soldering to the printed circuit board, and a resilient tab 53 extending from the body portion 51 and moveably received in the slot 17.

A pair of actuation wedge 6 are attached to the cover 3 by press fitting wedge portions 61 of the actuation wedge 6 into the holes 35 of the cover 3. Understandably, the actuation wedge 6 can be also integratedly formed with the cover via methods known to the person having ordinary skill in the art.

In the unlocking position, the metal ear 5 received in the housing 1 with the resilient tab 53 exposed in the slot 17. When the electronic module 8 is electrically and mechanically connected to the connector, the cover 3 is driven to rotate around the pivot hinge 15 and move towards the housing 1. In the locking position, the resilient tab 53 of the metal ear 5 is pressed by the actuation wedge 6, moves towards the receiving space 12, and finally engages with a groove 81 of the electronic module 8 to thereby locking the module 8 on the connector. Understandably, in the unlocking position, the electronic module 8 can be assembled to or removed from the connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, in this embodiment the cover 3 and the housing 1 are locked to each other via interengagement between the cutout 3 and the protrusion 14. Anyhow, other type interlocking device applied thereto is also workable.

What is claimed is:

1. An electrical connector for connecting an electronic module to a printed circuit board, comprising:

an insulative housing defining a receiving space for receiving the electronic module and having a base and a pair of lateral walls extending from the base with the receiving space defined therebetween, each lateral wall having a distal end portion, the housing defining an opening between the two distal end portions and opposite to the base, from which the electronic module can be inserted into the receiving space;

a plurality of contacts received in the base, each contact comprising a contact portion extending into the receiving space and a tail portion extending opposite to the contact portion for terminating to the printed circuit board; and a cover rotatablely attached to the end portions of the lateral walls of the insulative housing and being pivotally movable from an unlocked position for permitting insertion and removal of the electronic module from the housing to a locked position for the contact portions to electrically connect with the electronic module and for the cover and the housing to sandwich the electronic module therebetween.

2. The electrical connector as claimed in claim 1, further comprising a pair of metal ears assembled on the two lateral walls of the housing, respectively.

3. The electrical connector as claimed in claim 2, wherein the housing defines a slot communicating with the receiving space and wherein each metal ear forms a resilient tab movably received in the slot.

4. The electrical connector as claimed in claim 3, wherein the cover provides an actuation wedge engaging with and driving the metal ear to move into the receiving space for pressing against the electronic module when the cover is in the locked position.

5. The electrical connector as claimed in claim 4, wherein the cover defines a hole and the actuation wedge is press fitted in said hole.

6. The electrical connector as claimed in claim 4, wherein the actuation wedge is molded on the cover.

7. The electrical connector as claimed in claim 1, wherein the cover is formed from a piece of metal sheet and has a pair of pivot portions assembled to the end portions of the lateral walls of the housing.

8. The electrical connector as claimed in claim 7, wherein the cover has a finger access portion located oppositely to the pivot portions.

9. The electrical connector as claimed in claim 8, wherein the housing forms a wedge and wherein the cover defines a recess receiving the wedge for securing the cover on the housing.

10. The electrical connector as claimed in claim 1, wherein the cover is U-shaped.

11. The electrical connector as claimed in claim 10, further comprising a pair of metal ears retained in the lateral walls of the housing, each metal ear forming a resilient tab, wherein the cover provides an insulative wedge molded on lateral edges thereof and driving the resilient tab extending into the receiving space during the cover moves from the unlocked position to the locked position.

12. The electrical connector as claimed in claim 11, wherein the lateral wall of the housing provides a hinge on the end portion and wherein the cover defines a hinge hole rotatablely receiving the hinge.

13. The electrical connector as claimed in claim 11, wherein the lateral wall of the housing defines a recess on the end portion and wherein the cover provides a hinge rotatablely received in the recess.

14. An electrical connector assembly comprising:

an insulative housing defining opposite first and second ends along a lengthwise direction;

an insertion opening defined around the first end;

a plurality of contacts disposed closer to the second end than to the first end;

a cover pivotally defining opposite first and second end sections, said first end section being mounted to the housing around said first end; and interlocking devices formed on both the second end of the housing and the second end section of the cover for locking said cover and said housing together so as to prevent said cover from rotation away from the housing about said first end; wherein said insertion opening is configured to be enlarge enough to allow an optical module to extending therethrough and be received within a space between the cover and the housing for connecting to the contacts.

15. The electrical connector assembly as claimed in claim 14, wherein said cover further includes around the second end section a locking head resulting in locking of said optical module in the space.

16. The electrical connector assembly as claimed in claim 15, wherein said housing is further equipped with a locking ear which is actuated and deflected in a transverse direction perpendicular to said front-to-back direction by the locking head to lock the optical module in a vertical direction perpendicular to said front-to-back direction and said transverse direction.

17. The electrical connector assembly as claimed in claim 16, wherein the locking ear is received in a corresponding recess in the housing around the second end.

18. The electrical connector assembly as claimed in claim 14, wherein said housing defines a step structure around the first end to prevent backward movement of the optical module.

19. The electrical connector assembly as claimed in claim 18, wherein said cover defines a U-shaped structure in a top view when locked to the housing under condition that an opening of said U-shaped structure faces the first end section so as to allow the optical module to be inserted into the space in a tilted manner rather than a horizontal manner for preventing interfering with the step structure during installation of the optical module into the housing.

20. The electrical connector assembly as claimed in claim 14, wherein the insulative housing including a pair of lateral walls and a base, in which said contacts are located, connected with and between the pair of lateral walls at the second end, while having said pair of lateral walls separated from each other at the first end without the base connected therebetween.

* * * * *